US011821636B2

(12) United States Patent
Wang

(10) Patent No.: US 11,821,636 B2
(45) Date of Patent: Nov. 21, 2023

(54) OUTDOOR PORTABLE GAS STOVE

(71) Applicant: Haohong Electric Technology (Hubei) Co., Ltd., Huanggang (CN)

(72) Inventor: Min Wang, Huanggang (CN)

(73) Assignee: Haohong Electric Technology (Hubei) Co., Ltd., Huanggang (CN)

( * ) Notice: Subject to any disclaimer, the term of this patent is extended or adjusted under 35 U.S.C. 154(b) by 30 days.

(21) Appl. No.: 17/675,226

(22) Filed: Feb. 18, 2022

(65) Prior Publication Data

US 2023/0266014 A1 Aug. 24, 2023

(51) Int. Cl.

| | |
|---|---|
| ***F24C 3/14*** | (2021.01) |
| ***F24C 3/12*** | (2006.01) |
| ***F24C 15/10*** | (2006.01) |
| ***F24C 3/10*** | (2006.01) |
| ***F23D 14/04*** | (2006.01) |
| ***F24C 15/08*** | (2006.01) |

(52) U.S. Cl.

CPC ..... *F24C 3/14* (2013.01); *F23D 14/04* (2013.01); *F24C 3/103* (2013.01); *F24C 3/126* (2013.01); *F24C 15/086* (2013.01); *F24C 15/107* (2013.01)

(58) Field of Classification Search

CPC ..... F24C 3/103; F24D 14/04
USPC ..... 126/30, 29, 25 R, 9 R
See application file for complete search history.

(56) References Cited

U.S. PATENT DOCUMENTS 2,117,275 A 5/1938 Dailey
6,877,981 B1 * 4/2005 Kim ..... F24C 3/14 431/153
6,978,777 B2 12/2005 Pestrue et al.
2005/0109330 A1 * 5/2005 Pestrue ..... F24C 15/10 126/25 R
2010/0126496 A1 * 5/2010 Luo ..... F23D 14/06 126/39 E

FOREIGN PATENT DOCUMENTS

CN 110260319 A 9/2019
WO 2011030996 A1 3/2011

OTHER PUBLICATIONS

"Blackstone Single Burner Camp Stove—Portable—Adjustable Legs for Uneven Terrain—Anywhere Stove" Earliest review in Amazon Mar. 2019 (Year: 2019).*
Extended European Search Report issued in counterpart European Patent Application No. 22157461.9, dated Jul. 26, 2022.

* cited by examiner

*Primary Examiner* — Vivek K Shirsat
(74) *Attorney, Agent, or Firm* — Westbridge IP LLC

(57) ABSTRACT

Disclosed is an outdoor portable gas stove, which includes a stove cover, a burner, a gas pipeline, an ignition device and a flame-out protection device. The burner is arranged in the stove cover, an annular gas passage is formed in the burner, a gas outlet and combustion hole is defined on an upper end face of the burner, and the gas outlet and combustion hole is communicated with the annular gas passage. The ignition device is arranged above the gas outlet and combustion hole and is configured for igniting gas. The gas pipeline is communicated with the annular gas passage, and a control valve is arranged on the gas pipeline. The flame-out protection device is arranged above the gas outlet and combustion hole and connected with the gas pipeline. The technical proposal of the present application can realize an overall control of gas supply.

10 Claims, 6 Drawing Sheets

OUTDOOR PORTABLE GAS STOVE

TECHNICAL FIELD

The present application relates to the technical field of gas devices, in particular to an outdoor portable gas stove.

BACKGROUND

With a rising of social happiness index, people's outdoor activities are becoming more and more frequent, and there are some necessary outdoor operations. In order to enrich outdoor life and facilitate food processing, outdoor portable gas stoves have become favorable tools in outdoor activities.

In order to pursue a small volume, the existing outdoor portable gas stove adopts gas directly connecting with a burner, which can transport less gas. By setting wind shields around the burner, a fire cannot be effectively guaranteed not to be blown out, and there is no good safety remedy after the fire is blown out.

The outdoor portable gas stove has a small firepower, and cannot control the gas supply amount to change the firepower. After the fire is blown out, the gas supply cannot be automatically stopped, there are still certain potential safety hazards even in the outdoors.

SUMMARY

The present application mainly aims to provide an outdoor portable gas stove, aiming at solving a problem that the existing outdoor portable gas stove cannot carry out comprehensive control on gas transmission.

In order to achieve the above purpose, the present application provides an outdoor portable gas stove, in particular the present application includes:

- a stove cover;
- a burner, in particular an annular gas passage is formed in the burner, and a gas outlet and combustion hole is defined on an upper end face of the burner, and the gas outlet and combustion hole is communicated with the annular gas passage;
- an ignition device arranged above the gas outlet and combustion hole and configured for igniting gas;
- a gas pipeline communicating with the annular gas passage and being provided with a control valve; and
- a flame-out protection device arranged above the gas outlet and combustion hole and connected with the gas pipeline.

In one embodiment, the flame-out protection device is a thermoelectric flame-out protection device.

In one embodiment, the outdoor portable gas stove further comprises a foot bracket, which is detachably connected with the furnace cover, and a height of the foot bracket is adjustable.

In one embodiment, an upper surface of the burner is provided with annular bosses, the bosses are in a long arc shape in a radial direction of the burner, and each of the bosses is provided with a plurality of outlet gas combustion holes.

In one embodiment, the ignition device is an electronically controlled ignition device.

In one embodiment, the ignition device comprises a control key, the control valve comprises a control knob, the furnace cover is provided with a control panel, and the control key and the control knob are arranged on the control panel.

In one embodiment, the gas pipeline is divided into an internal pipeline and an external pipeline, the gas pipeline between the annular air passage and the control valve is the internal pipeline, and the rest is the external pipeline; an end of the external pipe far away from the control valve is provided with a connecting device for connecting the air supply equipment.

In one embodiment, the furnace cover is cylindrical, a top surface and a bottom surface of the furnace cover are communicated with outside, and the bottom surface is an inclined plane inclined inward and downward.

In one embodiment, an inner wall of the stove cover is connected with a fixing bracket, and the fixing bracket is configured for fixing and positioning the burner, the ignition device and the flame-out protection device.

In one embodiment, a bracket is arranged above the burner, and the bracket is connected with the stove cover.

According to the technical proposal of the present application, an annular passage is arranged in a burner to communicate the annular passage with a gas pipeline, an outlet combustion hole communicated with the annular passage is arranged on an upper end face of the burner, and an ignition device is arranged above the outlet combustion hole to realize flame ignition. The burner is placed in the stove cover to prevent wind and place cooking utensils. A control valve is arranged on the gas pipeline, and a flame-out protection device is arranged above the outlet combustion hole, so as to realize an adjustment of firepower and an automatic stop of air supply when flame-out, therefor meeting an overall control of outdoor portable gas stove on gas transmission.

BRIEF DESCRIPTION OF THE DRAWINGS

In order to more clearly explain the embodiment of the present application or the technical scheme in the related art, the drawings required for use in the description of embodiments or related art will be briefly described below. It is obvious that the drawings described below are only some embodiments of the present application, and other drawings can be obtained from the structure shown in these drawings without any creative effort by those of ordinary skill in the art.

The realization of the purposes, the functional characteristics and the advantages of the present application will be further explained in combination with the embodiment and with reference to the attached drawings.

DETAILED DESCRIPTION OF THE EMBODIMENTS

The technical solutions in the embodiments of the present application will be clearly and completely described in combination with the drawings in the embodiments of the present application. Obviously, the described embodiments are only a part of the embodiments of the present application, and not all of the embodiments. Based on the embodiments in the present application, all other embodiments obtained by ordinary skilled in the art without making creative labor belong to the scope of the present application.

It should be noted that all directivity indications (such as up, down, left, right, front, back, etc.) in the embodiments of the present application are only used to explain the relative position relationship and movement situation among various components under a specific posture (as shown in the attached figures). If the specific posture is changed, the directivity indications are changed accordingly.

In addition, the descriptions relating to "first", "second" and the like in the present application are for descriptive purposes only, and cannot be understood as indicating or implying their relative importance or implicitly indicating the number of indicated technical features. Thus, the features defined as "first", "second" may explicitly or implicitly include at least one of the features. In addition, the technical solutions among the various embodiments can be combined with each other, but must be based on the realization by ordinary skilled in the art. When the combination of the technical solutions is contradictory or unable to be realized, it should be considered that the combination of the technical solutions does not exist and is not within the scope of the present application.

The present application provides an outdoor portable gas stove.

Figure 1:
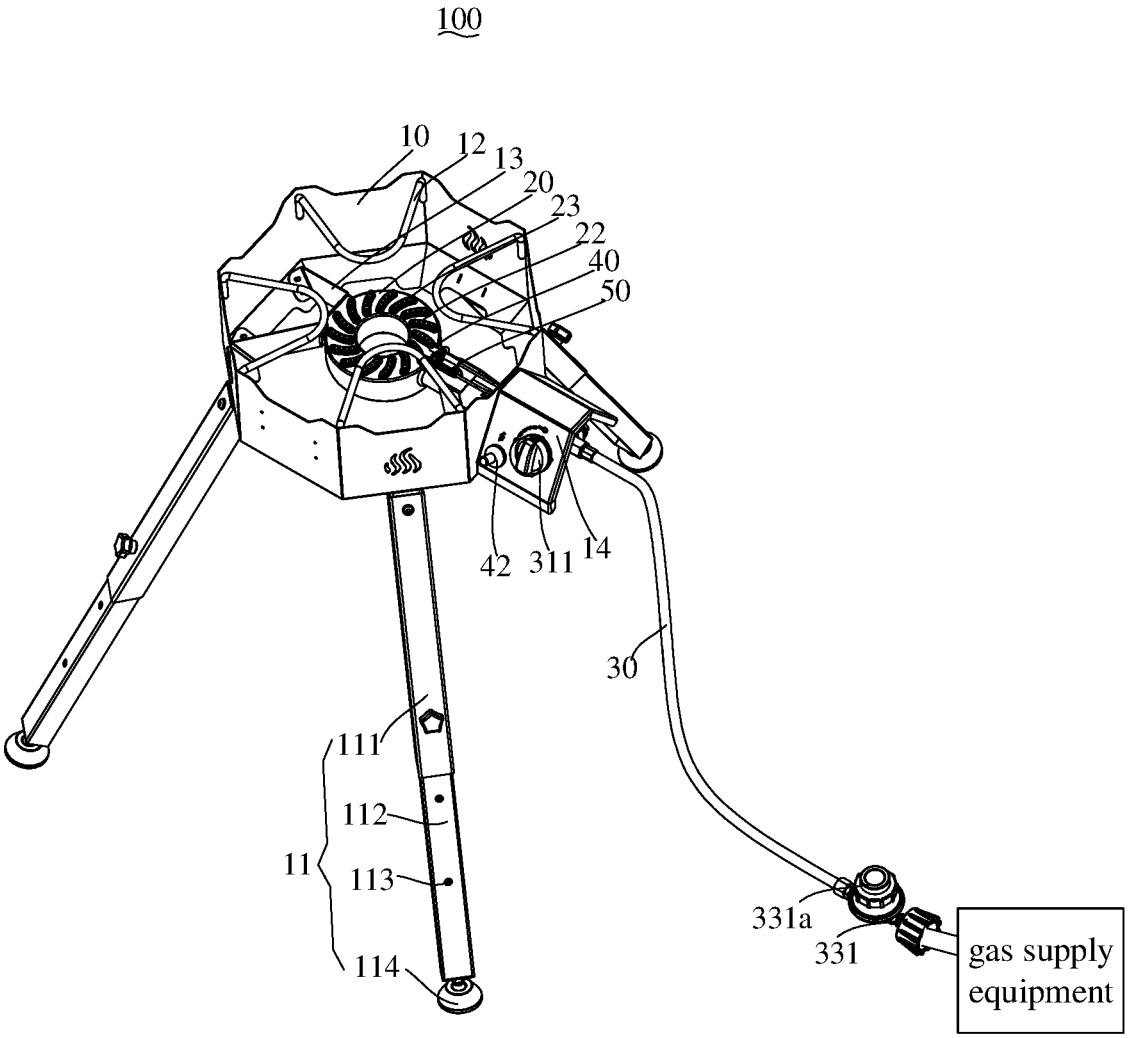
FIG. 1 is a structural schematic view of an embodiment of an outdoor portable gas stove of the present application.
Figure 2:
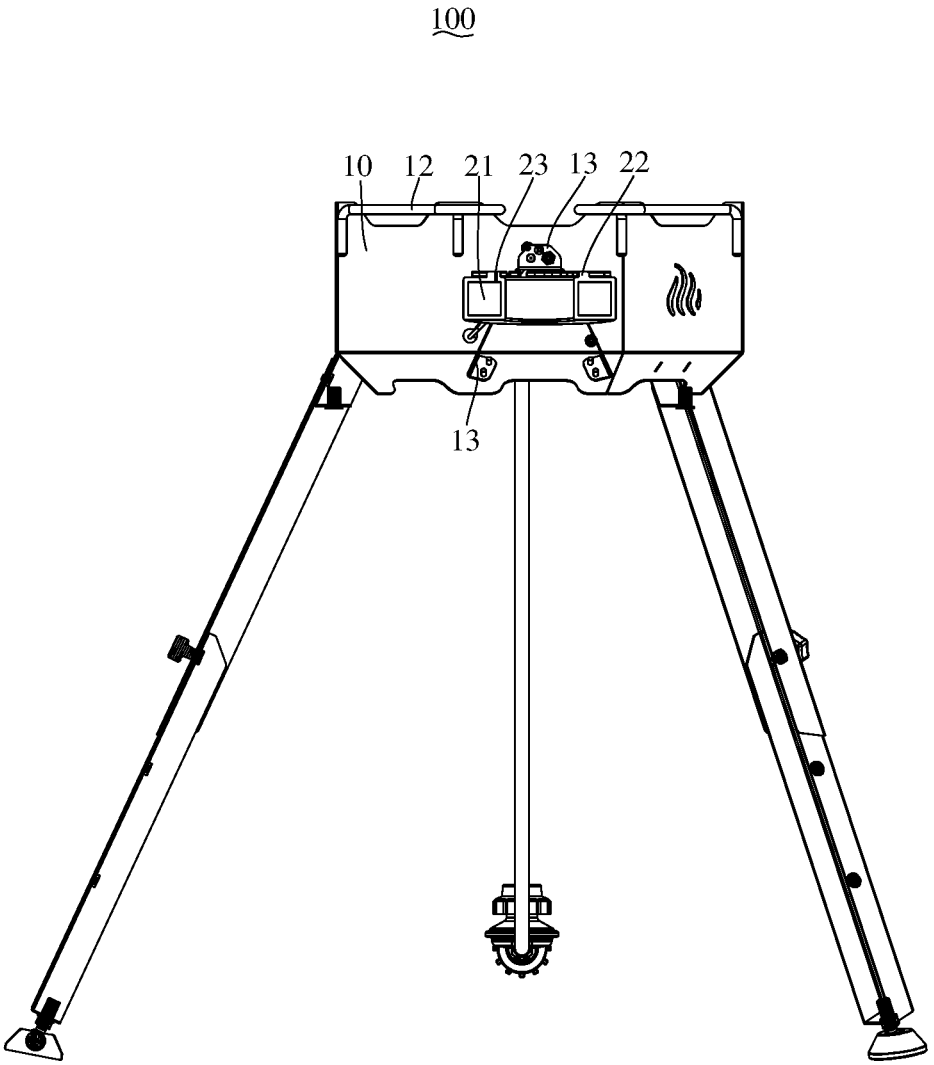
FIG. 2 is a schematic cross-sectional view of the outdoor portable gas stove of FIG. 1.

Referring to FIG. 1 and FIG. 2, an outdoor portable gas stove 100 includes a stove cover 10, a burner 20, an ignition device 40, a gas pipeline 30, and a flame-out protection device 50. The burner 20 is arranged in the stove cover 10, an annular gas passage 21 is formed in the burner 20, a gas outlet and combustion hole 23 is defined on an upper end face of the burner 20, and the gas outlet and combustion hole 23 is communicated with the annular gas passage 21. The ignition device 40 is arranged above the gas outlet and combustion hole 23 and configured for igniting gas. The gas pipeline 30 is communicated with the annular gas passage 21, and provided with a control valve 31. The flame-out protection device 50 is arranged above the gas outlet and combustion hole 23 and connected to the gas pipeline 30.

The outdoor portable gas stove 100 delivers gas to the burner 20 through the gas pipeline 30, and the control valve 31 is arranged on the gas pipeline 30, and can control and adjust the gas flow entering the burner 20. When the control valve 31 is opened, the gas enters the annular gas passage 21 of the burner 20. When the control valve is continuously opened, because the gas outlet and combustion hole is arranged at the upper end face of the burner 20 and communicates with the annular gas passage 21, a density of the gas is less than that of the air, and the gas slowly fills the annular gas passage 21, and at the same time, a portion of the gas is discharged from the gas outlet and combustion hole 23. The ignition device 40 is positioned above the gas outlet and combustion hole 23. After the ignition device 40 is controlled to start, the gas discharged from the gas outlet and combustion hole 23 is ignited. When the control valve 31 is adjusted to increase the gas flow input into the annular gas passage 21, a gas flow discharged from the gas outlet combustion hole 23 is also increased, and a gas concentration above the burner 20 is increased, so that the flame is also increased. When the control valve 31 is closed, the gas supply to the burner 20 is stopped, and when the gas in the annular gas passage 21 is consumed, the flame is extinguished.

The control valve 31 includes a control knob 311, which is rotated to control the gas flow from the gas pipeline 30 into the annular gas passage 21. The specific operation mode can be that a rotation angle range of the control knob 311 is set to 0 degrees to 180 degrees, when the control knob 311 is at an initial position, the control valve 31 is in a closed state. When the control knob 311 is rotated anticlockwise by 90 degrees, the maximum gas flow passes through the control valve 31, i.e., the flame reaches the maximum state. When the control knob 311 is continuously controlled to rotate anticlockwise by 90 degrees, the gas flow passing through the control valve 31 is gradually reduced, and the flame reaches the minimum state when the control valve 31 reaches a position of 180 degrees relative to the initial position.

The ignition device 40 is typically an electronically controlled ignition device 40. The electronically controlled ignition device 40 utilizes an electric spark principle, and instantaneous gas discharge phenomenon of flashing and emitting sound occurs between positive and negative charged areas with high potential difference. In the discharge space, gas molecules are ionized, and the gas is rapidly and violently heated, emitting flashing and sound, thus generating electric sparks. The electric ignition device 40 includes a control key 41. By adding a power supply, when the control key 41 is pressed, an electric ignition circuit can be turned on to generate electric sparks and ignite the gas to generate a flame. The electronically controlled ignition device 40 is an open flame ignition, which has advantages of small gas consumption, quick and reliable ignition, simple operation, easy control and convenient maintenance.

Figure 3:
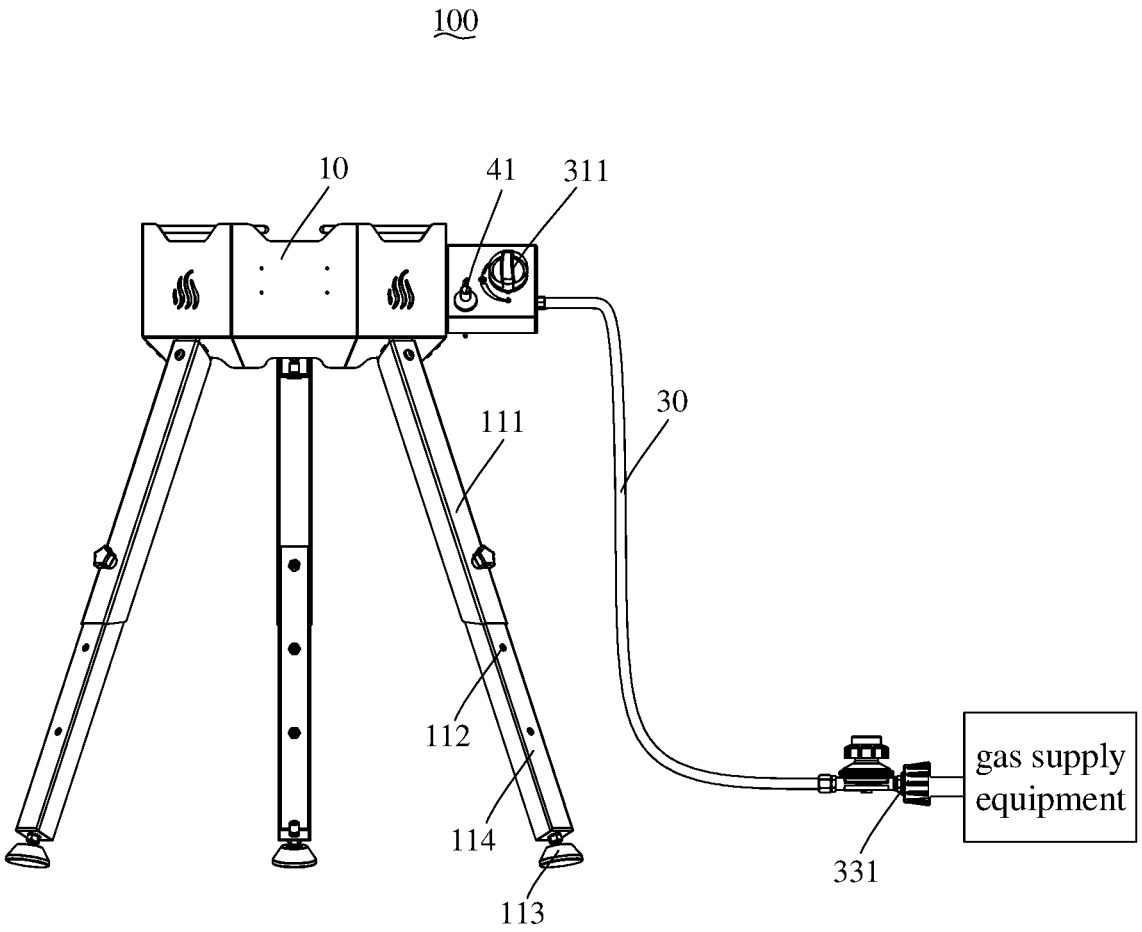
FIG. 3 is a structural schematic view of the outdoor portable gas stove of FIG. 1 from another perspective.
Figure 4:
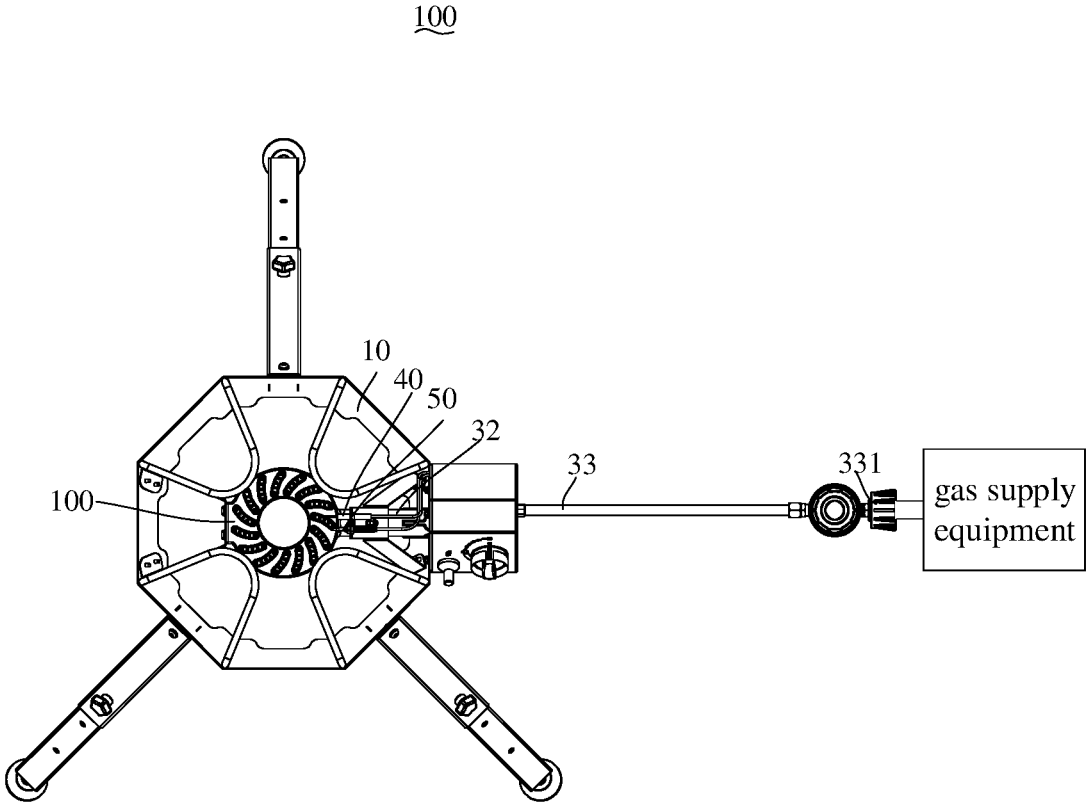
FIG. 4 is a schematic top view of the outdoor portable gas stove of FIG. 3.

Referring to FIG. 1 and FIG. 3, in one embodiment, in order to facilitate a control of the ignition device 40 and the control valve 31, the stove cover 10 is provided with a control panel 14, and the control key 41 and the control knob 311 are provided on the control panel 14. The control key 41 and the control knob 311 are arranged together to facilitate the sequential operations of starting the gas delivery and ignition, which is more convenient and simpler. The function of the control key 41 can also be realized by the control knob 311, for example, the pressing effect of the control key 41 can be achieved by the rapid rotation of the control knob 311.

The outdoor portable gas stove 100 is mainly operated outdoors. When used outdoors, it is easy to be blown by a strong wind to extinguish the flame of the burner 20. The burner 20 is arranged in the stove cover 10, and the stove cover 10 plays a windproof role for the burner 20. In order to better resist a strong wind blowing from outside, the stove cover 10 has a cylindrical shape, which can guide the strong wind blowing from outside to flow away to both sides. At the same time, a bottom wall of the stove cover 10 is inclined inwards and downwards, so as to guide an incoming wind from a lower side to flow downwards, so as to avoid a strong wind blowing into an interior of the stove cover 10 and extinguishing the flame.

Although the burner 20 can prevent most of the strong wind from blowing to the flame under the protection of the stove cover 10, oxygen must exist to ensure the continuous combustion of the flame, and it is impossible to seal the burner 20 in the stove cover 10. A top wall and the bottom wall of the stove cover 10 are both defined with openings to communicate the inner of the stove cover with the outside for oxygen to enter, so there is still some wind blowing to the flame, which may cause the flame to be extinguished, especially when the firepower is small, the flame is more easily blown out by the wind. After the flame is extinguished, it is sometimes not found in time, especially during outdoor activities, it is more likely to be distracted by other things and ignores the outdoor portable gas stove 100. After the flame is extinguished, the gas discharged from the annular passage 21 cannot be consumed, and if it is inhaled into a human body, it may cause physical discomfort and endanger health. After the flame-out protection device 50 is arranged on the gas outlet and combustion hole 23, the flame-out protection device 50 can detect whether the flame is extinguished, and after detecting that the flame is extinguished, the flame-out protection device 50 is connected with the gas pipeline 30 and can control the gas to stop being conveyed to the burner 20, therefore avoiding a harm of gas leakage.

The flame-out protection device 50 has various forms, including thermal flame-out protection, thermoelectric flame-out protection, photoelectric flame-out protection, or the like. In the present embodiment, a thermoelectric flame-out protection device 50 is employed, which utilizes heat energy generated when the gas is burned. The thermoelectric flame-out protection device 50 is composed of a thermocouple made of two different alloy materials and a solenoid valve. Different alloy materials will produce different thermoelectric potentials under an action of temperature. A thermocouple is made of different thermoelectric potentials produced by different alloy materials under an action of temperature, which makes use of an electrothermal difference of different alloy materials.

Figure 5:
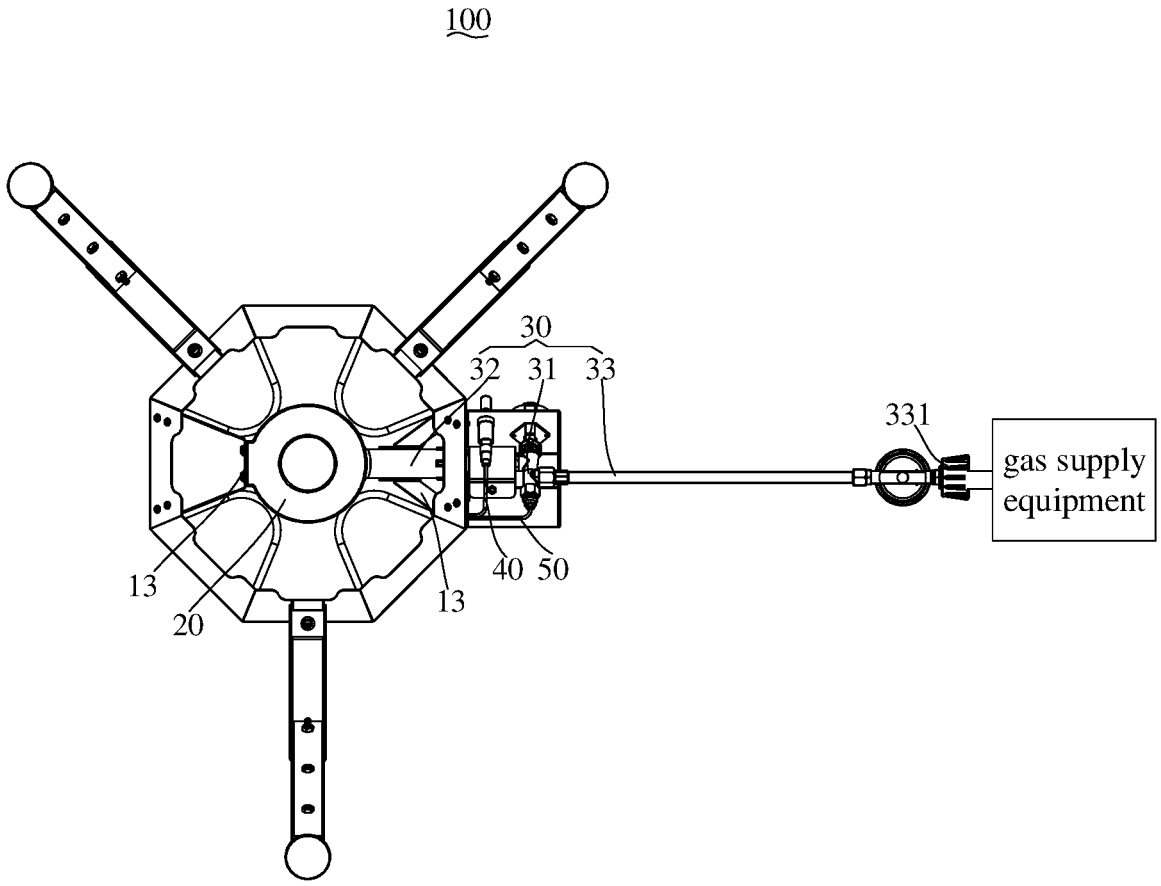
FIG. 5 is a schematic bottom view of the outdoor portable gas stove of FIG. 3.

Referring to FIG. 5, in one embodiment, the gas pipeline 30 is divided into an internal pipeline 32 and an external pipeline 33. The gas pipeline 30 between the annular gas passage 21 and the control valve 31 is the internal pipeline 32, and the rest is the external pipeline 33. The end of the external pipeline 33 away from the control valve 31 is provided with a connecting device 331 for connecting a gas supply device. When the outdoor portable gas stove 100 needs to be used, the gas supply device is connected to the gas pipeline 30 through the connecting device 331 to realize gas supply. When the outdoor portable gas stove 100 is not used, the gas supply device is disassembled, which is convenient for carrying the outdoor portable gas stove 100, and the volume of the gas supply device can be selected according to the required gas amount, which is suitable for various working scenes. The external pipeline 33 is detachably connected to the control valve 31. When the gas supply device cannot be moved or is inconvenient to move, and the gas supply device is far away from the outdoor portable gas stove 100, the external pipeline 33 with different lengths can be replaced, so that the use form of the outdoor portable gas stove 100 is more flexible and changeable. The connecting device 331 further includes a pressure regulating valve 331*a*, which can adjust a gas supply pressure of the gas supply equipment. When the gas supply pressure is larger, a gas transmission stability is stronger. When an outdoor wind is strong, the gas supply pressure can be increased through the pressure regulating valve 331*a* to ensure the stability of gas transmission and combustion.

The use effect of the outdoor portable gas stove 100 is not only related to a size of fire power, but also related to a heat distribution state. If the firepower is large but concentrated in a small area, when cooking food using the outdoor portable gas stove 100, due to uneven heat distribution, part of the food may be burnt and part of the food is not cooked well, thus reducing the use experience of the outdoor portable gas stove 100.

Figure 6:
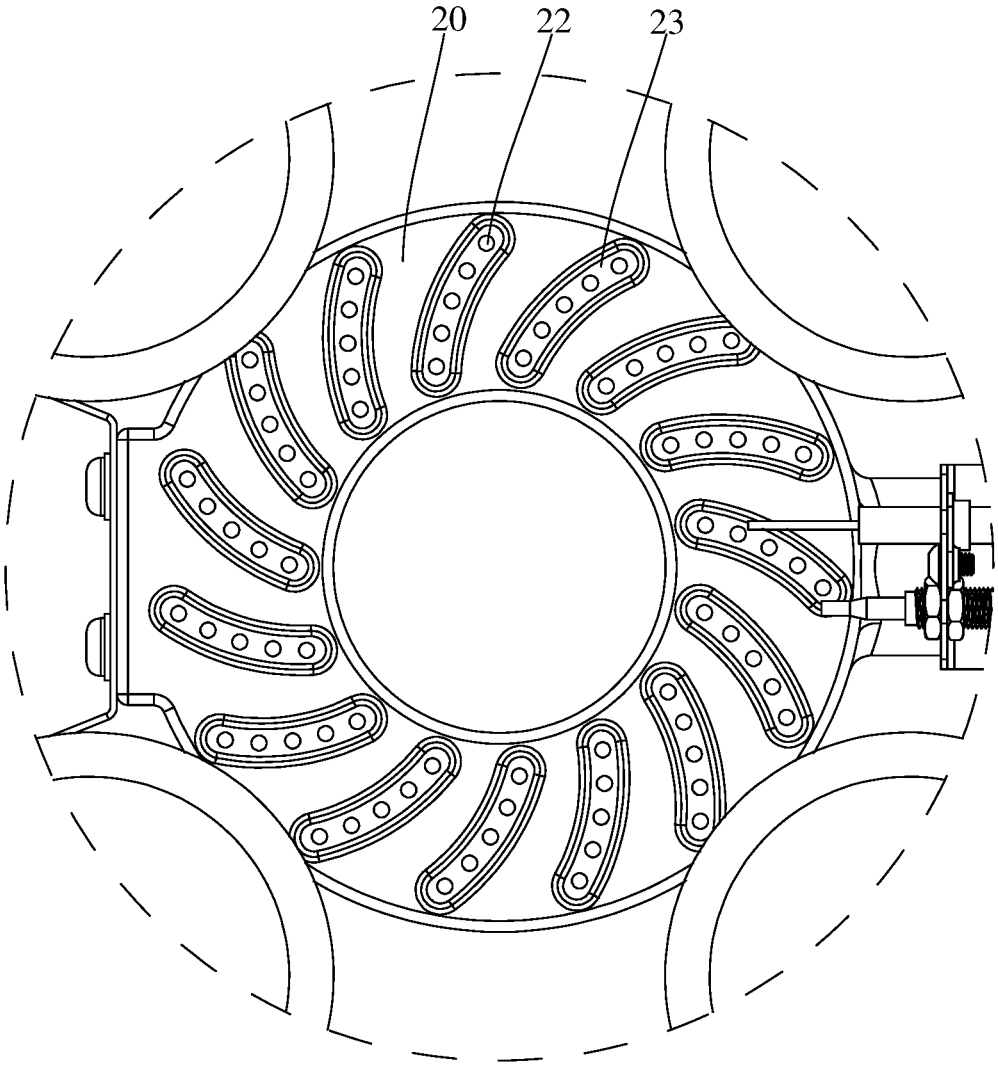
FIG. 6 is a schematic enlarged partial view of a burner in FIG. 4.

Referring to FIG. 1, FIG. 2 and FIG. 6, in view of this, in one embodiment, the upper surface of the burner 20 is provided with annularly arranged bosses 22, each boss 22 having a long arc shape in a radial direction of the burner 20, and each boss 22 being defined with a plurality of gas outlet and combustion holes 23. Since the bosses 22 are annularly arranged on an upper surface of the burner 20, and the gas outlet and combustion holes 23 are arranged on the bosses 22, that is, a plurality of gas outlet and combustion holes 23 are annularly arranged on the upper surface of the burner 20, after the gas outlet and combustion holes 23 are provided with flames, an annular area above the burner 20 can be uniformly heated, so that heat is uniformly distributed. The burner 20 is annular, in order to make a distribution of the gas outlet and combustion holes 23 more uniform, each boss 22 is arranged in a long arc shape in the radial direction of the burner 20, so that the distance between the gas outlet and combustion holes 23 near the center of the burner 20 and the distance between the gas outlet and combustion holes 23 near an edge of the burner 20 in two adjacent protrusions are approximately equal.

Referring to FIG. 1, FIG. 2 and FIG. 5, in an embodiment, in order to uniformly transfer heat to the space above the burner 20, the burner 20 is centered in the stove cover 10, and an inner wall of the stove cover 10 is connected with a fixing bracket 13 for fixing and positioning the burner 20, the ignition device 40 and the flame-out protection device 50. The fixing bracket 13 is connected with the interior of the stove cover 10 in many ways, including but not limited to screw connection, welding, magnet buckle connection, etc. The fixing bracket 13 is connected to the burner 20 and the ignition device 40 and the flame-out protection device 50 in a variety of ways, including but not limited to screw connection, welding, magnetic connection, etc. The fixing bracket 13 may be in the form of a strip bracket, directly and horizontally connected between the stove cover 10 and the burner 20. Preferably, the fixing bracket 13 is a trapezoidal bracket. The stove cover 10 are connected with the burner 20, the ignition device 40 and the flame-out protection device 50 by inclined frame, that is, the connection position between the fixed bracket 13 and the stove cover 10 is lower and/or higher than the connection positions between the fixed bracket 13 and the burner 20, the ignition device 40 and the flame-out protection device 50, thus forming a more stable mechanical structure.

When the outdoor portable gas stove 100 is in use, the heated cooking utensil are directly placed on an upper end face of the stove cover 10. In order to better transfer heat, the upper end face of the stove cover 10 is provided with an opening without a partition plate or the like in the middle. Therefore, when a diameter size of the cooking utensil is smaller than a diameter size of the stove cover 10, the cooking utensil cannot be placed on the stove cover 10, and the use of the outdoor portable gas stove 100 is limited. Meanwhile, for a convenience of carrying, an inner wall of the stove cover 10 is thinner. When the cooking utensil are placed on the stove cover 10, the pressure on the stove cover 10 is larger due to the small pressure-bearing area, which may cause damage to the outdoor portable gas stove 100.

Referring to FIG. 1, in view of this, in one embodiment, a bracket 12 is provided above the burner 20, and the bracket 12 is connected to the stove cover 10. The structure of the bracket 12 is U-shaped steel bars, and at least two of the U-shaped steel bars are circumferentially arranged at the upper opening of the stove cover 10, which can be two, three or four, etc. The U-shaped steel bars can be directly connected with the stove cover 10 by welding, or jacks can be arranged on the stove cover 10, and the U-shaped steel bars are inserted into the jacks. There are many specific connection forms. Due to the add of the bracket 12, the cooking utensil can be directly placed on the bracket 12, therefore satisfying the placement of small-diameter cooking utensils. Meanwhile, the U-shaped steel bars occupy a small area and will not affect the heat transfer. The bracket 12 can also be a steel mesh arranged at the upper opening of the stove cover 10, which can also play a role of supporting cooking utensils without affecting heat transfer.

In addition to the diameter size of the cooking utensils limiting the use of the outdoor portable gas stove 100, a use height also affects a use experience of the outdoor portable gas stove 100. For example, when using, heights for sitting people and standing people are different, and heights for different people are different. If the height of the outdoor stove is fixed, the comfortable use height cannot be guaranteed and the use experience is affected.

According to FIGS. 1 and 3, in one embodiment, a foot bracket 11 is connected to the stove cover 10, and a height of the foot bracket 11 is adjustable. According to FIGS. 1 and 3, in one embodiment, a foot bracket 11 is connected to the furnace cover 10, and the height of the foot bracket 11 is adjustable. The foot bracket 11 and the furnace cover 10 are connected in many ways. In order to facilitate carrying and increase the use scenarios of the outdoor portable gas stove 100, the foot bracket 11 and the furnace cover are preferably detachable. When the outdoor portable gas stove 100 is in an idle state, the foot bracket 11 can be disassembled, thereby saving the space for placing the outdoor portable gas stove 100 and being convenient to carry. At the same time, when used on a table top or the like, the height has satisfied the use of the user, the foot bracket 11 can be disassembled, and the outdoor portable gas stove 100 can be directly placed on the table top or the like for use, thus satisfying various use scenarios of the outdoor portable gas stove 100. In this embodiment, the foot bracket 11 is divided into two parts: an upper bracket 111 and a lower bracket 112. The lower bracket 112 has a plurality of screw holes 113 at different heights, and the upper bracket 111 has a screw at a fixed position. The screw for adjusting the upper bracket 111 is connected with the screw holes 113 of different heights on the lower bracket 112, thereby realizing height adjustment of the outdoor portable gas stove 100. Screw holes 113 may also be provided at different heights of the upper bracket 111, a plurality of screw holes 113 with different heights can be maintained on the lower bracket 112, or only one hole can be provided, and the screw holes 113 with different heights of the upper bracket 111 and the lower bracket 112 are connected and fixed by screws and nuts, so that a height adjustment of the outdoor portable gas stove 100 can be realized. The foot bracket 11 can also be divided into a plurality of bracket sections, and each bracket section can be detachably connected, such as screw connection, buckle connection, magnetic attraction connection, etc., and the height adjustment of the outdoor portable gas stove 100 can be realized by increasing and decreasing the number of bracket sections. At least three foot brackets 11 are arranged circumferentially around the outer periphery of the stove cover 10, in order to ensure a stability of the foot brackets 11 supporting the outdoor portable gas stove 100. Furthermore, in order to improve the stability of the foot bracket 11 placed on the ground, a hollow frustum 114 can be connected to an end of the foot bracket 11 near the ground, and a diameter of an end of the frustum 114 near the ground is larger than a diameter of an end of the frustum 114 connected with the foot bracket 11. Setting the frustum 114 to be hollow can reduce the contact area with the ground, increase the pressure of the outdoor portable gas stove 100 on the ground, and maintain a stable state of placement. When the foot bracket 11 and the furnace cover 10 are disassembled and separated, the frustum 114 can be directly installed on the furnace cover 10. At this time, the outdoor portable gas stove 100 can be placed on the desktop for use, further increasing the usable scene of the outdoor portable gas stove 100.

The burner 20 may be made of aluminum alloy material or copper material, the aluminum alloy material is light and convenient to carry the outdoor portable gas stove 100, and the copper material has good thermal conductivity and corrosion resistance. The stove cover 10 can be made of stainless steel, which is corrosion resistant and high temperature resistant.

The above is only a preferred embodiment of the present application. The patent scope of the present application is not therefore limited, and any equivalent structural transformation made by utilizing the contents of the specifications and drawings of the present application or any direct/indirect application in other related technical fields under the inventive concept of the present application is included in the patent protection scope of the present application.

What is claimed is:

1. An outdoor portable gas stove, comprising:

a stove cover;

a burner, wherein an annular gas passage is formed in the burner, and a gas outlet and combustion hole is defined on an upper end face of the burner, and the gas outlet and combustion hole is communicated with the annular gas passage;

an ignition device arranged above the gas outlet and combustion hole and configured for igniting gas;

a gas pipeline communicating with the annular gas passage and being provided with a control valve; and a flame-out protection device arranged above the gas outlet and combustion hole and connected with the gas pipeline;

wherein an upper surface of the burner is provided at intervals with annular bosses around a center of the burner, and each of the bosses is of a long arc shape and rotationally distributed in a radial direction of the burner, and a plurality of outlet gas combustion holes are provided on an upper surface of each of the bosses.

2. The outdoor portable gas stove according to claim 1, wherein the flame-out protection device is a thermoelectric flame-out protection device.

3. The outdoor portable gas stove according to claim 1, wherein the outdoor portable gas stove further comprises a foot bracket, which is detachably connected with the stove cover, and a height of the foot bracket is adjustable.

4. The outdoor portable gas stove according to claim 1, wherein the ignition device is an electronically controlled ignition device.

5. The outdoor portable gas stove according to claim 4, wherein the ignition device comprises a control key, the control valve comprises a control knob, the furnace cover is provided with a control panel, and the control key and the control knob are arranged on the control panel.

6. The outdoor portable gas stove according to claim 1, wherein the gas pipeline is divided into an internal pipeline and an external pipeline, the gas pipeline between the annular gas passage and the control valve is the internal pipeline, and the gas pipeline not between the annular air passage and the control valve is the external pipeline; an end of the external pipe far away from the control valve is provided with a connecting device for connecting the gas supply equipment.

7. The outdoor portable gas stove according to claim 1, wherein the stove cover is cylindrical, a top surface and a bottom surface of the furnace cover are communicated with outside, and the bottom surface is an inclined plane inclined inward and downward.

8. The outdoor portable gas stove according to claim 1, wherein an inner wall of the stove cover is connected with a fixing bracket, and the fixing bracket is configured for fixing and positioning the burner, the ignition device and the flame-out protection device.

9. The outdoor portable gas stove according to claim 1, wherein a bracket is arranged above the burner, and the bracket is connected with the stove cover.

10. The outdoor portable gas stove according to claim 6, wherein the connecting device further comprises a pressure regulating valve configured to adjust a gas supply pressure of the gas supply equipment.

* * * * *